US007901522B2

(12) United States Patent
Hollrigl et al.

(10) Patent No.: US 7,901,522 B2
(45) Date of Patent: Mar. 8, 2011

(54) ALUMINUM ALLOY WITH INCREASED RESISTANCE AND LOW QUENCH SENSITIVITY

(75) Inventors: Gunther Hollrigl, Stein am Rhein (CH); Christophe Jaquerod, Noes (CH)

(73) Assignee: Alcan Technology & Management Ltd., Neuhausen am Rheinfall (CH)

( * ) Notice: Subject to any disclaimer, the term of this patent is extended or adjusted under 35 U.S.C. 154(b) by 0 days.

(21) Appl. No.: 12/402,966

(22) Filed: Mar. 12, 2009

(65) Prior Publication Data

US 2009/0223608 A1 Sep. 10, 2009

Related U.S. Application Data

(62) Division of application No. 10/541,788, filed as application No. PCT/EP03/14696 on Dec. 20, 2003, now abandoned.

(30) Foreign Application Priority Data

Jan. 16, 2003 (EP) ..... 03405013

(51) Int. Cl.
*C22F 1/053* (2006.01)

(52) U.S. Cl. ..... 148/552; 148/694; 148/701

(58) Field of Classification Search ..... 148/551, 148/552, 693, 694, 701
See application file for complete search history.

(56) References Cited

U.S. PATENT DOCUMENTS 3,542,606 A * 11/1970 Westerman et al. ..... 148/694

(Continued)

FOREIGN PATENT DOCUMENTS

FR 2341661 9/1977

(Continued)

OTHER PUBLICATIONS

Key to Aluminum Alloys, 4th Edition, (1991), Aluminium-Schlussel + Key to Aluminium Alloys, pp. 195-205.

(Continued)

*Primary Examiner* — Roy King
*Assistant Examiner* — Janelle Morillo
(74) *Attorney, Agent, or Firm* — Bachman & LaPointe, P.C.

(57) ABSTRACT

An aluminium alloy having high mechanical strength and low quench sensitivity comprising 4.6 to 5.2 wt. % Zn, 2.6 to 3.0 wt. % Mg, 0.1 to 0.2 wt. % Cu, 0.05 to 0.2 wt. % Zr, max. 0.05 wt. % Mn, max. 0.05 wt. % Cr, max. 0.15 wt. % Fe, max. 0.15 wt. % Si, max. 0.10 wt. % Ti and aluminium as the remainder along with production related impurities, individually max. 0.05 wt. %, in total max. 0.15 wt. %. A process for producing plates having a thickness of more than 300 mm for manufacturing moulds for injection-moulding plastics is made up of the following steps: continuous casting the alloy into ingots having a thickness greater than 300 mm, heating the ingots to a temperature of 470 to 490° C. with a max. heating rate of 20° C./h between 170 and 410° C., homogenising the ingots for 10 to 14 h at a temperature of 470 to 490° C., cooling the ingots in still air to an intermediate temperature of 400-410° C., cooling the ingots by means of forced air cooling from the intermediate temperature of 400-410° C. to a temperature of less than 100° C., cooling the ingots to room temperature, artificially age-hardening the ingots at elevated temperature. The artificially age-hardened ingots can be employed for manufacturing moulds for injection-moulding plastics.

8 Claims, 3 Drawing Sheets

U.S. PATENT DOCUMENTS

| | | | | | |
|---|---|---|---|---|---|
| 3,694,272 | A | | 9/1972 | Mohondro et al. | |
| 4,618,382 | A | * | 10/1986 | Miyagi et al. | 148/415 |
| 5,306,362 | A | * | 4/1994 | Gupta et al. | 148/552 |
| 5,389,165 | A | * | 2/1995 | Cho | 148/552 |
| 5,961,752 | A | * | 10/1999 | Bergsma | 148/550 |
| 2002/0134474 | A1 | * | 9/2002 | Cho | 148/699 |

FOREIGN PATENT DOCUMENTS

| | | |
|---|---|---|
| JP | 05070910 | 3/1993 |
| JP | 07252573 | 10/1995 |
| JP | 10168533 | 6/1998 |

OTHER PUBLICATIONS

Hoellrigl, G. "Relation between microstructure and exfoliation corrosion in aluminum-zinc-magnesium alloys", Internationale Leightmetalltagung, (1981) 7th, pp. 133-135.

* cited by examiner

ALUMINUM ALLOY WITH INCREASED RESISTANCE AND LOW QUENCH SENSITIVITY

CROSS-REFERENCE TO RELATED APPLICATIONS

This application is the U.S. Divisional Application of Ser. No. 10/541,788 filed Jul. 11, 2005, abandoned, which is a U.S. National Stage of PCT/EP2003/014696, filed Dec. 20, 2003, which claims priority of European Application No. 03405013.8 filed Jan. 16, 2003.

BACKGROUND OF THE INVENTION

The present invention relates to an aluminium alloy having high strength and low quench sensitivity. Also within the scope of the invention is a process for manufacturing thick plates of the aluminium alloy.

In particular in the automobile industry there is an increasing demand for large plastic components such as e.g. integral bumpers. In order to manufacture the corresponding large moulds for injection moulding purposes it is necessary to have plates with a thickness often greater than 150 mm, in some cases even greater than 500 mm.

Today, normally hot rolled and artificially aged, i.e. plates heat-treated at elevated temperature, are employed for manufacturing injection moulding moulds with a thickness e.g. of 50 to 300 mm. Larger moulds, thicker than 300 mm, are manufactured either out of forged blocks or directly from continuously cast ingots.

One significant disadvantage of the aluminium alloys employed today for mould manufacture is their high quench sensitivity. In order that the ingots or plates reach the necessary strength level for plastic injection moulding moulds by means of artificial age hardening, the rate of cooling from the homogenisation or solution treatment temperature has to be increased with increasing plate thickness. Due to the resultant high temperature gradients between the surface and the core of the ingot or plate, the magnitude of the undesirable internal stresses increases, so that also for this reason there are limits to increasing the cooling rate further and with that the strength level that can be reached.

An object of the invention is to provide a suitable aluminium alloy of low quench sensitivity for manufacturing thick plates having a high strength level.

A further objective of the invention is to provide a suitable process by means of which the aluminium alloy can be processed to thick plates having adequate high strength over the whole plate thickness.

SUMMARY OF THE INVENTION

The objectives are achieved by way of the invention by providing an aluminium alloy comprising 4.6 to 5.2 wt. % Zn
2.6 to 3.0 wt. % Mg
0.1 to 0.2 wt. % Cu
0.05 to 0.2 wt. % Zr
max. 0.05 wt. % Mn
max. 0.05 wt. % Cr
max. 0.15 wt. % Fe
max. 0.15 wt. % Si
max. 0.10 wt. % Ti the remainder being aluminium with impurities arising out of the production process, each individually amounting at most to 0.05 wt. %, in total at most 0.15 wt. %.

BRIEF DESCRIPTION OF THE DRAWINGS

Further advantages, features and details of the invention are revealed in the following description of exemplified embodiments and with the aid of the drawing which shows in FIG. 1 the distribution of the Brinell hardness over a part of the cross-section of a continuously cast ingot with a cross-section of 440 mm×900 mm after fan cooling.

DETAILED DESCRIPTION

Figure 1:
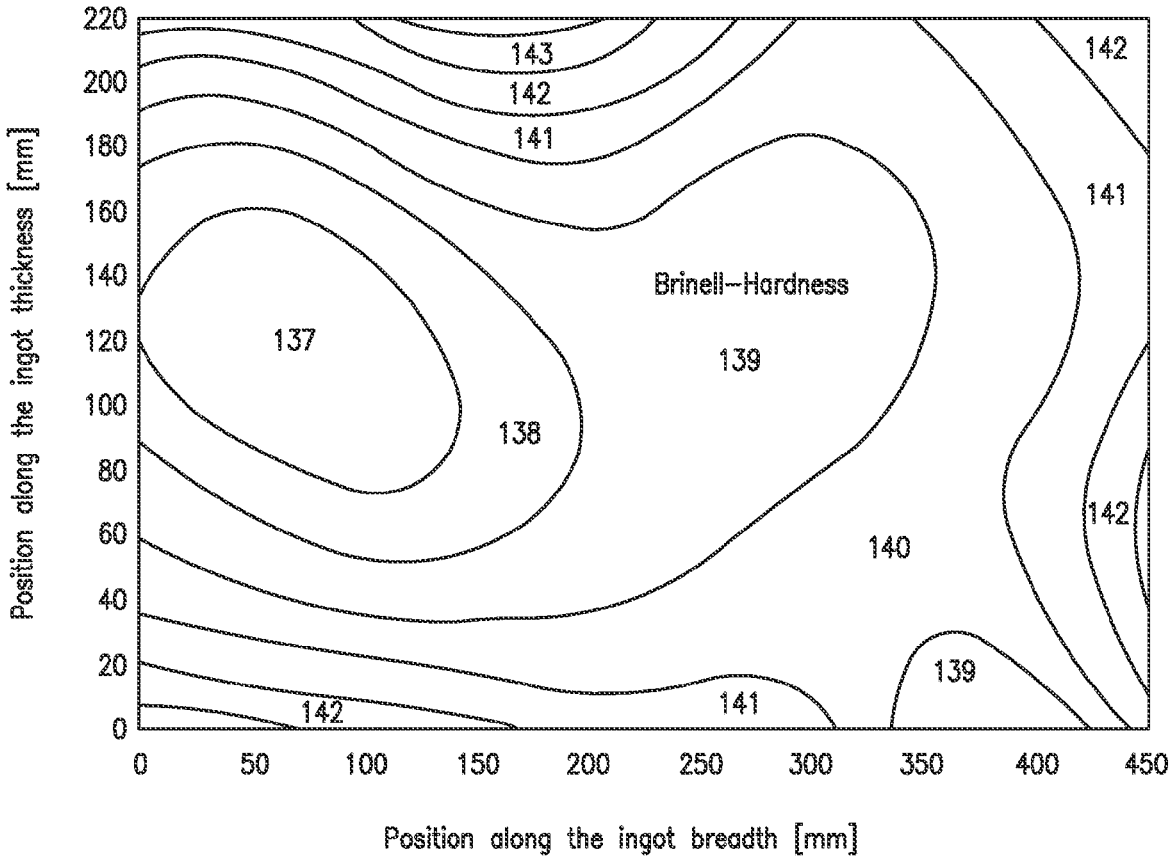

The composition of the alloy according to the invention is selected such that it exhibits very low quench sensitivity and in spite of that has an extremely high strength level. Thick cross-sections can therefore be brought to a high strength level by means of forced air cooling and precipitation hardening.

The preferred range for the individual alloying elements are as follows:

4.6 to 4.8 wt. % Zn
2.6 to 2.8 wt. % Mg
0.10 to 0.15 wt. % Cu
0.08 to 0.18 wt. % Zr
max. 0.03 wt. % Mn
max. 0.02 wt. % Cr
max. 0.12 wt. % Fe
max. 0.12 wt. % Si
max. 0.05 wt. % Ti For the alloy according to the invention to be employed as a material for mould manufacture it is necessary to strive for the most isotropic distribution of internal stresses in the cross-section of the plate. Amongst other factors the grain size and the shape of grain in the plate are significant for reducing the internal stresses. The finer and more uniform the grains, the easier it is for the internal stresses in the cross-section of the plate to equalise. The grain boundaries act as sinks for dislocations during the reduction of local stress peaks. As explained below, by the addition of zirconium it is possible to achieve a fine grain structure in the plate by selecting the rate of heating the ingot to a homogenisation or solution treatment temperature such that as the distribution of submicron precipitates of Al3Zr in the structure is as homogeneous as possible.

Suitable for manufacturing plates of the alloy according to the invention are the following two methods, which depending on the desired thickness of the mould, lead to a hot rolled and artificially age-hardened plate or to an artificially age-hardened ingot employed as plate. The process for manufacturing plates with a thickness of up to 300 mm is characterised by the following steps:

A. Continuous casting the aluminium alloy as an ingot with a thickness greater than 300 mm, B. Heating the ingot at a maximum heating rate of 20° C./h between 170 and 410° C. to a temperature of 470 to 490° C., C. Homogenising the ingot for an interval of 10 to 14 h at a temperature of 470 to 490° C., D. Hot rolling the homogenised ingot to plate, E. Cooling the plate from a temperature of 400 to 410° C. to a temperature of less than 100° C., F. Cooling the plate to room temperature G. Artificially age-hardening the plate.

To manufacture plates with a thickness of greater than 300 mm and in particular plates of thickness greater than 500 mm one may employ directly as plate the continuously cast ingot made from the alloy according to the invention. The process in this case is characterised by the following steps:

A. Continuous casting the aluminium alloy as an ingot with a thickness greater than 300 mm, B. Heating the ingot at a maximum heating rate of 20° C./h between 170 and 410° C. to a temperature of 470 to 490° C., C. Homogenising the ingot for an interval of 10 to 14 h at a temperature of 470 to 490° C., D. Cooling the ingot to an intermediate temperature of 400 to 410° C., E. Cooling the ingot from the intermediate temperature of 400 to 410° C. to a temperature below 100° C., F. Cooling the ingot to room temperature, G. Artificially age-hardening the ingot, H. Using the artificially age-hardened ingot as plate.

In a preferred embodiment of the invention the cooling of the ingot from the homogenisation temperature of 470-490° C. to the intermediate temperature of 400-410° C. takes place in still air.

The cooling of the ingot from the intermediate temperature of 400 to 410° C. should preferably be so fast that the loss of strength is as small as possible. However, the cooling rate should also not be too great as this will cause the internal stresses to be excessive.

The cooling of the ingot from the intermediate temperature of 400 to 410° C. to a temperature below 100° C. preferably takes place by forced air cooling or in a of water-air-spray mist.

When selecting the cooling conditions it is also necessary to take into account the thickness of the ingot. It is however, within the scope of knowledge of experts in the field to determine the optimum cooling conditions for a given ingot format by means of straightforward trials.

The low heating rate in the temperature range 170 to 410° C. on heating the ingot to the homogenisation temperature is a significant feature of the process according to the invention. In the mentioned temperature range—also called the heterogenisation interval—the equilibrium AlZnMg phase (T-phase) is stable. Passing slowly through the heterogenisation interval leads to a finely dispersed precipitation of the T-phase, whereby the phase boundary interfaces of the precipitated particles of T-phase form preferred nucleant for the Al3Zr particles which start to precipitate out at around 350° C. On heating the ingot further to the homogenisation temperature the previously precipitated T-phase particles dissolve leaving behind a uniform distribution of the fine, submicron Al3Zr precipitates, which lie on the original particle interfaces of the T-phase and on the subgrain boundaries, thus resulting in a homogeneous distribution. These fine Al3Zr particles effect a strong resistance to grain growth on recrystallisation of the plate both during solution treatment and during homogenisation treatment of the cast ingot, producing the desired isotropic grain structure in the ingot. The grain refining additive Zr is therefore utilised in an optimal manner.

A further essential feature of the process according to the invention is the combined homogenisation and solution treatment with subsequent two-stage cooling—this in contrast to the normal state-of-the-art process in which a separate solution treatment with subsequent quenching at a high cooling rate is necessary to obtain acceptable strength also in the middle of the ingot.

By "forced air cooling" is to be understood here as air-cooling aided by fans leading to a heat-transfer coefficient at the ingot surface of around 40 $W/m^2K$. Cooling in a water-air-spray mist leads to a slightly higher heat-transfer coefficient at the ingot surface.

The alloy according to the invention exhibits low quench sensitivity. On manufacturing thick plates the loss in strength in the core of the plate is, in spite of the relatively mild cooling conditions, smaller than with alloys according to the state-of-the-art. Surprisingly, it has been found that this effect is even more pronounced in plates manufactured directly from continuously cast ingots than is the case with hot rolled plates.

The two-stage cooling from the homogenisation temperature to room temperature has been found to be particularly advantageous in the production of thick plates as a means of achieving a structure with low internal stresses.

For artificial age-hardening preference is given to a sequence involving ageing at room temperature, a first heat-treatment at a first temperature and a second heat-treatment at a second temperature which is higher than the first temperature e.g.

1 to 30 days at room temperature, 6 to 10 h at a temperature of 90 to 100° C., 8 to 22 h at a temperature of 150 to 160° C.

Especially preferred is artificial age-hardening to the heat-treat condition T76.

The field of application of the alloy according to the invention and the thick plates manufactured therefrom results from the above described range of properties. The plates are suitable in particular for manufacturing moulds i.e. for moulds for injection moulding of plastic, but also in general for manufacturing machines, tools and moulds.

Example

An alloy with the composition (in wt. %): 0.040 Si, 0.08 Fe, 0.14 Cu, 0.0046 Mn, 2.69 Mg, 0.0028 Cr, 4.69 Zn, 0.017 Ti, 0.16 Zr, rest Al was cast on an industrial scale as a continuously cast ingot of cross-section 440 mm×900 mm. The ingots were heated within 30 h to a temperature of 480° C., whereby the heating rate in the range 170-410° C. was less than 20° C./h. The homogenisation of the ingot to equalise the segregation arising during solidification was performed by holding the ingot for 12 h at 480° C.

The homogenised ingots were cooled from the homogenisation temperature in a first stage in still air to an intermediate temperature of 400° C. and subsequently in a second stage with forced air cooling from 400° C. to 100° C. The further cooling to room temperature took place again in still air.

After 14 days at room temperature, the ingots were artificially age-hardened for 8 h at 95° C. followed by 18 h at 155° C. to the over-aged condition T76.

The Brinell hardness was measured on samples sawn out of the artificially age-hardened ingot perpendicular to the longitudinal direction. The areas exhibiting the same hardness shown in FIG. 1 indicate clearly the low loss in hardness or strength in the ingot core compared with the hardness at the surface of the ingot.

Figure 2:
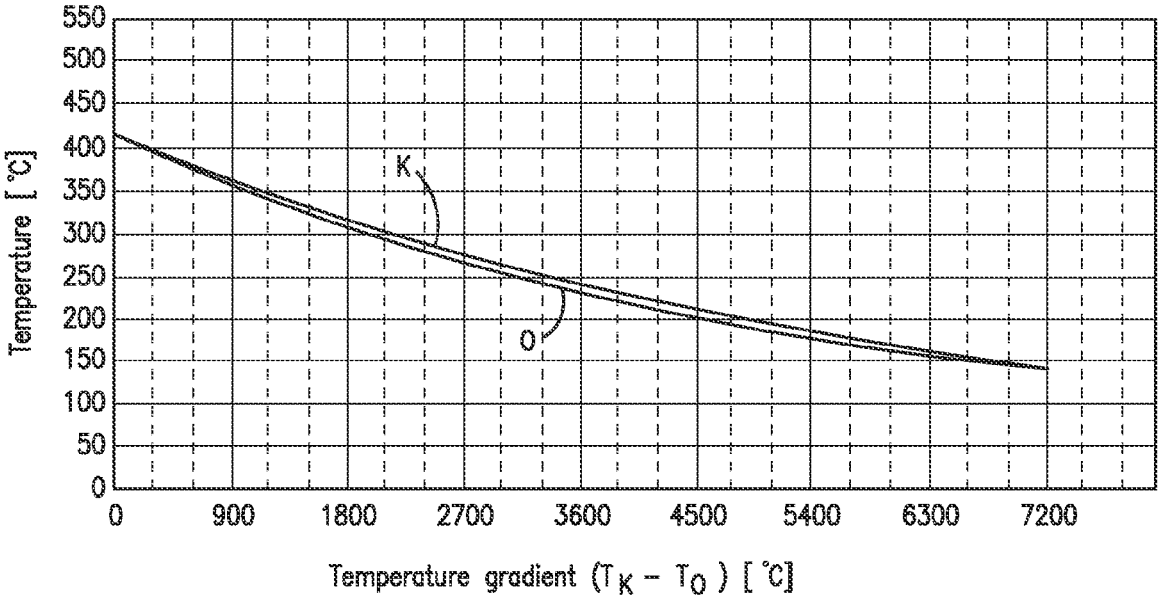
FIG. 2 the temperature change in a continuously cast ingot with a cross-section of 440 mm×900 mm at the surface and in the middle during fan cooling.
Figure 3:
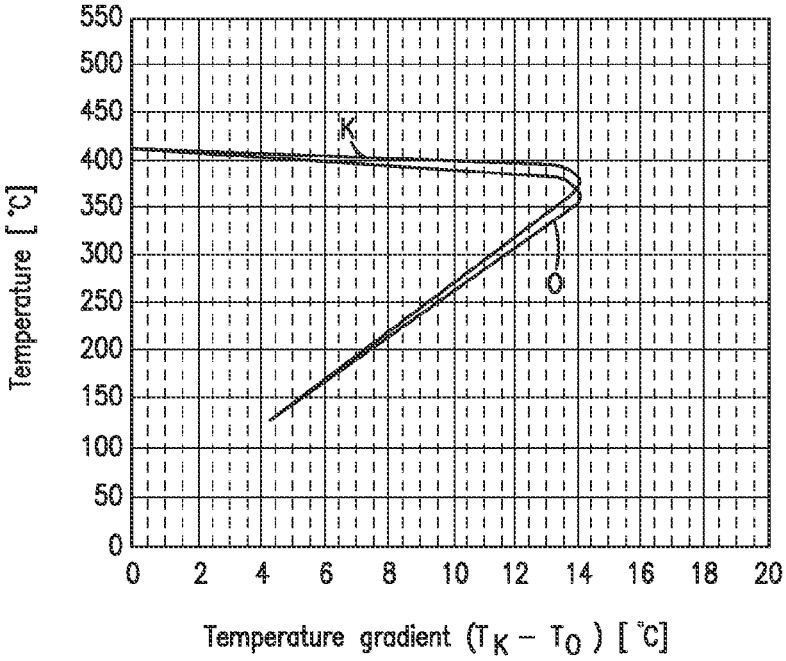
FIG. 3 the calculated change in the inner temperature gradients for the temperature plot shown in FIG. 2.
Figure 4:
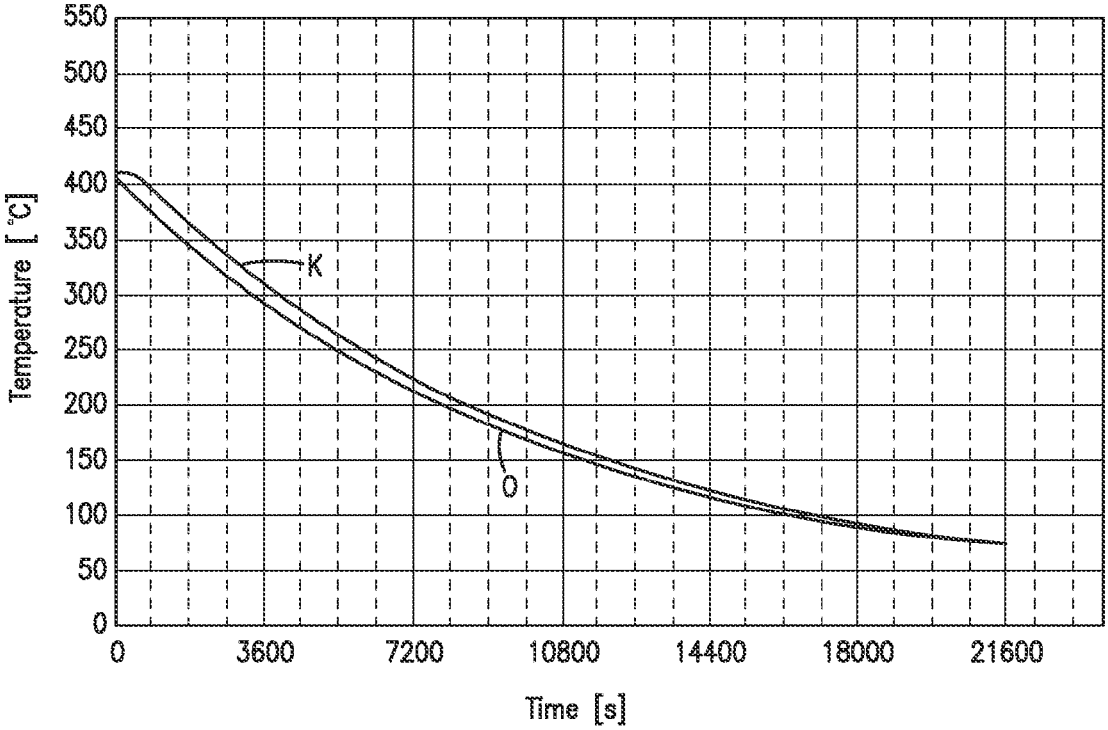
FIG. 4 the calculated change in temperature gradient in a continuously cast ingot with a cross-section of 1000 mm×1200 mm at the surface and in the middle during fan cooling.
Figure 5:
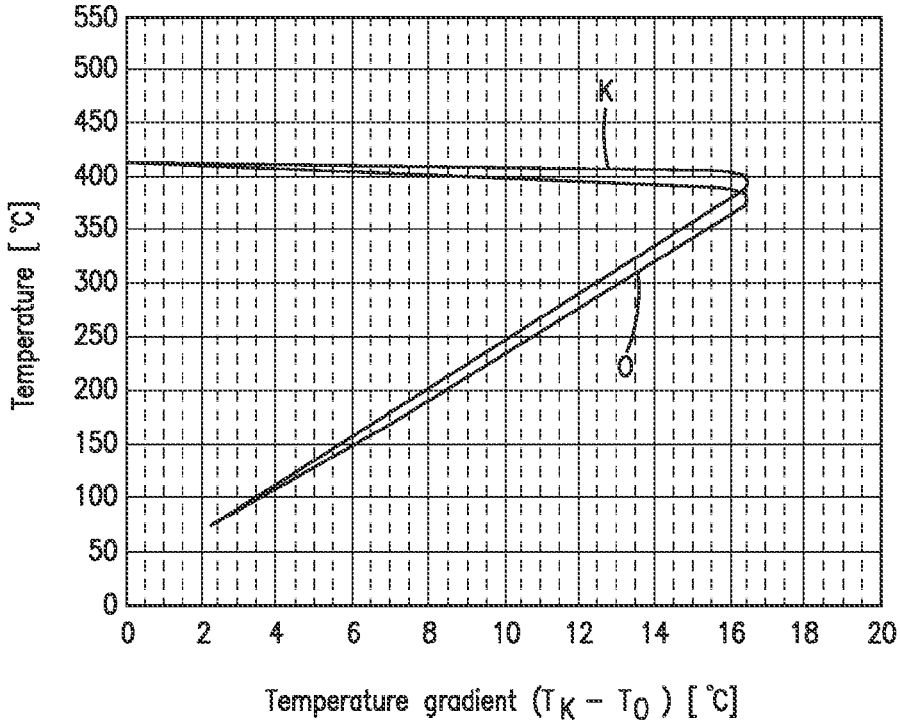
FIG. 5 the calculated change in the inner temperature gradients for the temperature plot shown in FIG. 4.

Shown in FIG. 2 are the temperature-time plots calculated for the surface (O) and the core (K) of an ingot with a cross-section of 440×900 mm cooled by fan cooling and in FIG. 3 the gradients derived therefrom between the temperature $T_K$ in the ingot core and the temperature $T_O$ at the ingot surface. For comparison purposes FIGS. 4 and 5 show the corresponding curves for an ingot with a cross-section of 1000×1200 mm. The results show that with ingots with a thickness of up to 1000 mm the process according to the invention is able to meet the strength requirements made of plates for manufacturing moulds for injection moulding plastic.

The invention claimed is:

1. Process for manufacturing plates having a thickness up to 300 mm out of an aluminium alloy comprising the steps of:

(a) continuous casting the aluminium alloy comprising 4.6 to 5.2 wt. % Zn, 2.6 to 3.0 wt. % Mg, 0.1 to 0.2 wt. % Cu, 0.05 to 0.2 wt. % Zr, max. 0.05 wt. % Mn, max. 0.05 wt. % Cr, max. 0.15 wt. % Fe, max. 0.15 wt. % Si, max. 0.10 wt. % Ti, as an ingot having a thickness of greater than 300 mm;

(b) heating the ingot at a maximum heating rate of 20° C./h between the temperature range of 170 and 410° C. to a final temperature of between 470 to 490° C.;

(c) homogenising the heated ingot for an interval of 10 to 14 h at the final temperature range of 470 to 490° C.;

(d) hot rolling the homogenised ingot to plate having a thickness of up to 300 mm;

(e) cooling the plate from a temperature of 400 to 410° C. to a temperature of less than 100° C.; and (f) artificially age-hardening the plate.

2. Process for manufacturing plates having a thickness of greater than 300 mm out of an aluminium alloy, comprising the steps of:

(a) continuous casting the aluminium alloy comprising 4.6 to 5.2 wt. % Zn, 2.6 to 3.0 wt. % Mg, 0.1 to 0.2 wt. % Cu, 0.05 to 0.2 wt. % Zr, max. 0.05 wt. % Mn, max. 0.05 wt. % Cr, max. 0.15 wt. % Fe, max. 0.15 wt. % Si, max. 0.10 wt. % Ti, as an ingot having a thickness of greater than 300 mm;

(b) heating the ingot at a maximum heating rate of 20° C./h at the temperature range of between 170 and 410° C. to a final temperature of 470 to 490° C.;

(c) homogenising the ingot for an interval of 10 to 14 h at a temperature of 470 to 490° C.;

(d) cooling the ingot to an intermediate temperature of 400 to 410° C.;

(e) cooling the ingot from the intermediate temperature of 400 to 410° C. to a temperature below 100° C.;

(f) further cooling the ingot to room temperature;

(g) artificially age-hardening the ingot; and (h) forming the artificially age-hardened ingot into a plate having a thickness of greater than 300 mm.

3. Process according to claim 2, including cooling of the ingot from the homogenisation temperature of 470-490° C. to the intermediate temperature of 400-410° C. in still air.

4. Process according to claim 2 or 3, including cooling of the ingot from the intermediate temperature of 400-410° C. to a temperature below 100° C. by forced air cooling.

5. Process according to claim 2 or 3, including cooling of the ingot from the intermediate temperature of 400-410° C. to a temperature below 100° C. in a water-air-mist spray.

6. Process according to claim 2 or 3, including artificial age-hardening, after storage at room temperature, in a first heat-treatment at a first temperature, followed by a second heat-treatment at a second temperature which is higher than the first temperature.

7. Process according to claim 6, including the steps of:

(1) storage for 1-30 days at room temperature;

(2) first heat-treatment for 6-10 h at a temperature of 90-100° C.; and (3) second heat-treatment for 8-22 h at a temperature of 150-160° C.

8. Process according to claim 7, wherein the artificial age-hardening is carried out resulting in a heat-treatment condition T76.

* * * * *